United States Patent [19]

Nakano et al.

[11] Patent Number: 4,514,709

[45] Date of Patent: Apr. 30, 1985

[54] CIRCUIT BREAKER

[75] Inventors: Kunimitsu Nakano; Takaaki Chuzawa; Masaru Ohmuro, all of Osaka, Japan

[73] Assignee: Matsushita Electric Works, Ltd., Osaka, Japan

[21] Appl. No.: 518,300

[22] PCT Filed: Mar. 31, 1983

[86] PCT No.: PCT/JP83/00101

§ 371 Date: Jun. 23, 1983

§ 102(e) Date: Jun. 23, 1983

[87] PCT Pub. No.: WO83/03496

PCT Pub. Date: Oct. 13, 1983

[30] Foreign Application Priority Data

Mar. 31, 1982 [JP] Japan ..... 57-50914

[51] Int. Cl.[3] ..... H01H 9/30

[52] U.S. Cl. ..... 335/201; 335/23; 335/35

[58] Field of Search ..... 335/23, 38, 39, 35, 335/174, 191; 200/147 B, 148 C, 153 G

[56] References Cited

U.S. PATENT DOCUMENTS

| | | | |
|---|---|---|---|
| 2,945,109 | 7/1960 | Fehling | 335/201 |
| 3,025,376 | 3/1962 | Yarrick | 200/148 C |
| 3,031,552 | 4/1962 | Stewert | 200/147 B |
| 3,329,913 | 7/1967 | Camp | 335/38 |
| 3,599,130 | 8/1971 | Murai et al. | 335/174 |
| 4,376,270 | 3/1983 | Staffen | 335/35 |
| 4,393,287 | 7/1983 | Nakano . | |

FOREIGN PATENT DOCUMENTS

| | | |
|---|---|---|
| 2967 | 9/1950 | Japan . |
| 15552 | 6/1961 | Japan . |
| 18258 | 10/1966 | Japan . |
| 193452 | 12/1976 | Japan . |
| 12955 | 1/1979 | Japan . |
| 16022 | 6/1979 | Japan . |

*Primary Examiner*—E. A. Goldberg
*Assistant Examiner*—George Andrews
*Attorney, Agent, or Firm*—Burns, Doane, Swecker & Mathis

[57] ABSTRACT

A circuit breaker of the present invention provides a movable contact held by a movable contactor to be capable of passing through the interior of an arc suppressing means and to be contacted with a fixed contact from the side of the arc suppressing means. Thus, an arc generated upon an opening of the both contacts is made to shift immediately into the arc suppressing means, whereby arc dividing, cooling and suppressing are performed rapidly and the current limiting effect of the breaker is remarkably elevated.

5 Claims, 9 Drawing Figures

CIRCUIT BREAKER

TECHNICAL FIELD

This invention relates to circuit breakers capable of breaking an associated circuit upon a short-circuit or when an overcurrent higher than a rated current keeps flowing and, more specifically, to a circuit breaker improved remarkably in the current limiting effect so as to be able to reliably protect any circuit specifically including such elements not withstandable to short-circuit current as semiconductors.

BACKGROUND ART

The circuit breaker of the kind referred to comprises, as has been disclosed in, for example, U.S. Pat. No. 3,329,913 and Japanese Patent Publication No. 18258/1966, a fixed contactor carrying a fixed contact, a movable contactor carrying a movable contact contactable with the fixed contact, a manual contact opening and closing mechanism normally operable to separate the movable contactor from the fixed contactor and including a trip means which forcibly separates the movable contactor from the fixed contactor, an electromagnetic device operating in response to the short-circuit current as well as the overcurrent to attract an armature linked to the trip means, and an arc suppressing means disposed adjacent contacting and separating position of the fixed and movable contacts.

Thus the contacts are normally closed and opened by means of the manual contact opening and closing mechanism which moves the movable contactor with respect to the fixed contactor whereas, upon the short-circuit or when the over-current higher than the rated current keeps flowing, they are opened by means of the trip means which separates the movable contactor from the fixed contactor with an actuation of the electromagnetic device and attraction of the armature. An arc generated upon such contact opening is shifted towards the arc suppressing means to be therein divided, cooled and suppressed.

In the known circuit breaker, however, a relatively long time has been required until a complete arc suppression is achieved after the separation of the movable contactor from the fixed contactor by the trip means specifically upon the actuation of the electromagnetic device due to the short-circuit current which produces the attraction of the armature. Due to that, for example, the arc suppressing means is merely disposed adjacent the contacting and separating position of the contacts, rendering the relatively long time required for driving and drawing the arc towards the arc suppressing means by a magnetic driving force and consequently until the complete arc suppression is reached, and so on, the entire device has been functionally insufficient. Accordingly, there has been a problem that, in an event where the circuit of which breaking is to be made includes such elements low in the withstand voltage as semiconductor elements, they are damaged by a high voltage applied thereto upon the short-circuit. It has been desired for the circuit breaker of the kind referred to that the movable contactor is rapidly separated from the fixed contactor specifically at the time of the actuation of the electromagnetic device responsive to the short-circuit current, and that the arc suppression is achieved in an extremely short time, so that the current limiting effect can be remarkably improved and a smooth application to the circuit involving the elements of low voltage can be achieved.

DISCLOSURE OF THE INVENTION

A primary object of the present invention is to obtain a circuit breaker which shortens the required time from the separating motion of the movable contactor from the fixed contactor upon the actuation of the electromagnetic device detected a current higher than a predetermined rated value to the arc suppression to a large extent, and improves the current limiting effect remarkably.

According to the present invention, specifically, the movable contactor is so formed that at least a part holding the movable contact will pass through the interior of the arc suppressing means upon the trip operation and contact opening motion, whereby the arc suppressing efficiency is remarkably elevated and thus the current limiting effect can be improved.

According to the present invention, further, the movable contactor is caused to be propelled so as to promote its opening motion immediately after a release from a latch member upon the trip operation, whereby the instantaneous responsibility is made excellent and thus the current limiting effect is elevated.

BEST MODE FOR WORKING THE INVENTION

Figure 1:
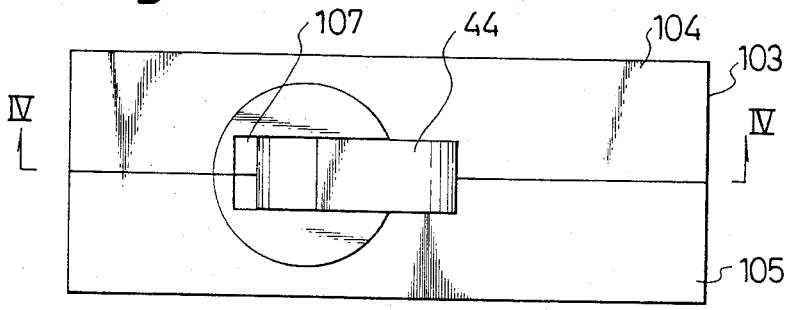
FIG. 1 is a plan view of the circuit breaker according to the present invention.

Referring to the drawings, a circuit breaker 10 is provided with an electromagnetic device 11, a manual contact opening and closing mechanism 12 including a trip mechanism operably coupled to the electromagnetic device 11 and being shiftable into a tripped state when a large current is caused to flow, a closing and opening contact section 13 including a movable contactor 14 and fixed contactor 15 and provided to be capable of contacting a movable contact 16 of the movable contactor 14 with and separating the same from a fixed contact 17 of the fixed contactor by operating the manual contact opening and closing mechanism 12, and an arc suppressing means 18 provided for allowing at least a part of the movable contactor 14 where the movable contact 16 is held or secured to pass therethrough when the movable contactor 14 performs its contact opening motion.

The foregoing arrangement shall be further detailed together with references to a unique arrangement according to the present invention. In the electromagnetic device 11, a rectangular yoke 20 of a magnetic material is provided, and a cylinder 22 on which a coil 21 for detecting the overcurrent is wound is secured to the yoke 20. In the cylinder 22, a magnetic head 23 is secured substantially in the center, and first plunger 24 to which loads of a viscous fluid and spring are applied and second plunger 25 are disposed to oppose each other with the magnetic head 23 interposed between them. In this case, any overcurrent flowed through the coil 21 causes initially the first plunger 24 to be attracted to the magnetic head 23 while being subjected to a retarding action due to the viscousity of the fluid and spring load and then the second plunger 25 also attracted to the head 23 with an increased magnetic force. When, on the other hand, such a large current as a short-circuit current is flowed to the coil 21, the second plunger 25 is caused to immediately be attracted to the magnetic head 23 without waiting for the attraction of the first plunger 24 to the head 23. One of led-out ends of the coil 21 is projected out of the yoke and connected to a lead wire 26 having a sufficient flexibility, and the other led-out end is extended downward from the yoke 20 and secured to a terminal metal fitting 27 of the breaker. For details of the foregoing electromagnetic device, references U.S. patent application Ser. No. 366,099, now U.S. Pat. No. 4,427,959 issued Jan. 24, 1984.

At the upper end portion of a side part of the yoke 20, there is provided a frame 28 for supporting the manual contact opening and closing mechanism including the trip mechanism so as to be integral and to project substantially in extended direction of the upper beam part of the yoke 20. The frame 28 comprises vertically and mutually parallelly extended short and long framing parts 29 and 30. In the short framing part 29, there are provided shaft bearing holes 32 and 33 respectively made in the foremost end extension 31 and rearward upper corner, as well as a further shaft bearing hole 34 made in the rearward portion below the hole 33. The long framing part 30 is provided, on the other hand, with a shaft bearing hole 36 made in an expanded part 35 provided at a position corresponding to the extension 31 of the short framing part 29, and with shaft bearing holes 37 and 38 respectively in the rearward portion at its corresponding positions to the holes 33 and 34 in the short framing part 29. In the long framing part 30, further, a reverse L-shaped guide aperture 39 is formed to have at one part an arcuate edge 40. A tip end part 41 of the framing part 30 is bent substantially perpendicularly. Such bent part 41 is provided at the upper edge with an engaging part 42 and at the lower edge with a horizontal arc running extension 43 of a small disk shape.

In the manual contact opening and closing mechanism 12, a handle 44 has a shaft bearing hole 46 made in the center of a lower cylindrical part 45 which is provided at a part of its periphery with an expanded part 48 having a through hole 47. The handle 44 is rotatably supported by the frame 28 with a supporting shaft 49 passed through the hole 46 and born at the shaft bearing holes 32 and 36 of the short and long framing parts 29 and 30. In the through hole 47, one leg 51 of a U-shaped link pin 50 is inserted, and the free end of this leg 51 is freely engaged in the L-shaped guide aperture 39 of the long framing part 30 to be shiftable along the arcuate edge 40. The other leg 52 of the link pin 50 is passed through respective shaft bearing holes 57 and 58 of projections 55 and 56 provided to oppose each other on a link arm 54 while its free end is engaged freely in the guide aperture 39 so as to be slidable in a vertical part thereof.

The link arm 54 itself is provided with a base part 59 of a reverse U-shape as seen endwise, and an engaging opening 60 is made in the base part 59. From forward end of the base part 59, mutually parallel and vertically downwardly extended arms 61 and 62 on which the projections 55 and 56 are provided extend integrally from the base part, and shaft bearing holes 63 and 64 are provided in respective tip ends of the arms 61 and 62. Further, one of the arms has a kicking tongue 65 projected from the lower edge as bent into an L-shape and slightly slanted upward with respect to the vertical direction, and also a stopping projection 66 projected from the upper edge as bent also into an L-shape to be substantially horizontal. A support shaft 67 is born in the shaft bearing holes 63 and 64 at the tip ends of the arms 61 and 62, as passed through a shaft bearing hole 68 of the movable contactor 14 of an angled shape and connected through the lead wire 26 to one end of the detecting coil 21, whereby the movable contactor 14 is pivoted to the link arm 54. At a position above the shaft bearing hole 68 of the movable contactor 14, an expanded part 70 having an engaging hole 69 is provided to project upward, while the movable contact 16 made of a contacting material preferably of a high conductivity is secured to the tip end at its lower edge.

The above described movable contact 16 of the movable contactor 14 is disposed to be contactable with the fixed contact 17 made preferably of a highly conductive material and secured to the fixed contactor 15 disposed below the movable contactor 14. The fixed contactor 15 per se is made to be slanted at one leg 71A part of a U-shaped portion 71 to which the fixed contact 17 is secured. The fixed contact is disposed at a level between the longitudinal ends of the arc suppressor. A part 72A of the fixed contactor extends diagonally downward from the fixed contact toward the longitudinal axis 111 of the arc suppressing means 18 and partially within a recess 96 thereof and terminates as a tip end or arc running part 72 opposing the arc running extension 43 of the frame 28. A connecting part 74 made integral with a terminal end of the form of a metal fitting 73 is provided as extended from the other leg part of the U-shaped portion 71 and bent into an L-shape.

According to another feature of the present invention, there is provided an arrangement for positively energizing the operation of the trip mechanism to accelerate the contact-opening-motion speed of the movable contactor 14. Referring further to the trip mechanism, an interlocking arm 76 of the trip mechanism is pivoted to a support shaft 75 born in the shaft bearing holes 33 and 37 of the frame 28. This interlocking arm includes a base part 78 having a notch 77 for engaging thereto the head part of the second plunger 25 of the electromagnetic device 11. A pair of arms 79 and 80 are extended from the forward end of the base part 78 vertically and mutually parallel support shaft 75 is born in shaft bearing holes 81 and 82 made in the respective arms 79 and 80, and the interlocking arm 76 is pivoted to the frame 28 as referred to above. The one arm 79 is extended downward as bent to be L-shape, and a kicking foot 83 is projected to be capable of hitting the kicking tongue 65 of the link arm 54 to propel the same. To the support shaft 75, further, a lever or a latch member 84 of an L-shape as seen sideward and operating integrally with the interlocking arm 76 is pivoted through shaft bearing holes 85 and 86. One extension of this latch member 84 is formed to be an arm 87 which is normally separated slightly from the lower surface of the base part 78 of the interlocking arm 76 but is engageable thereto upon its actuation. The other extension is extended downward to be provided as a leg 89 having a hook 88 to be projected into the engaging opening 60 of the link arm 54 and engaged to an edge of the same.

Figure 2:
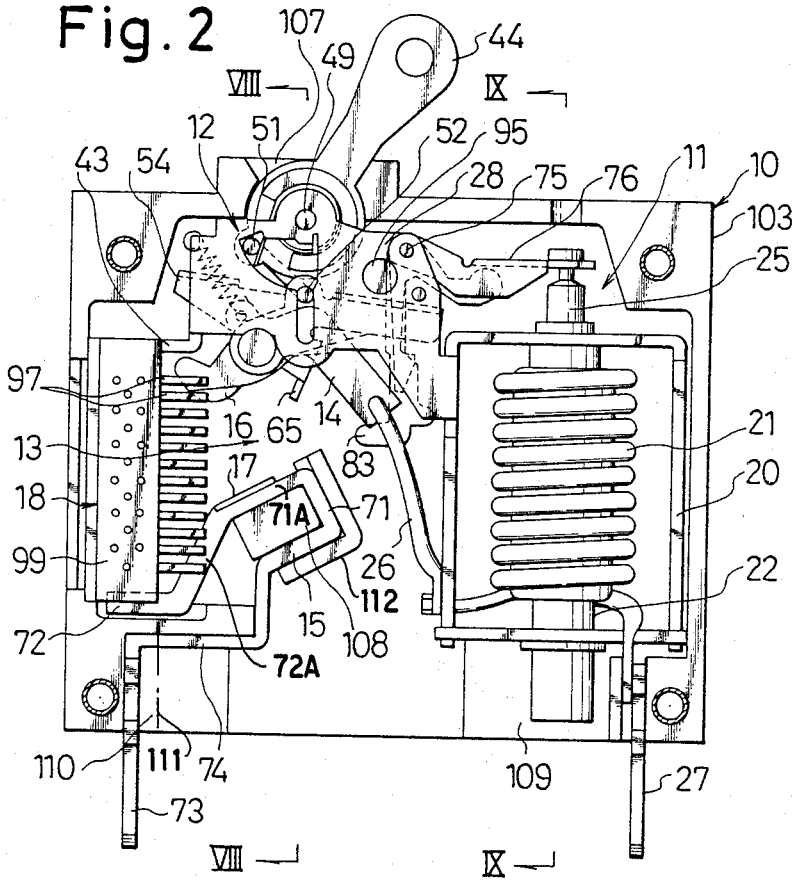
FIG. 2 is a side elevation of the breaker of FIG. 1 with one of two dividable halves of its casing removed.
Figure 3:
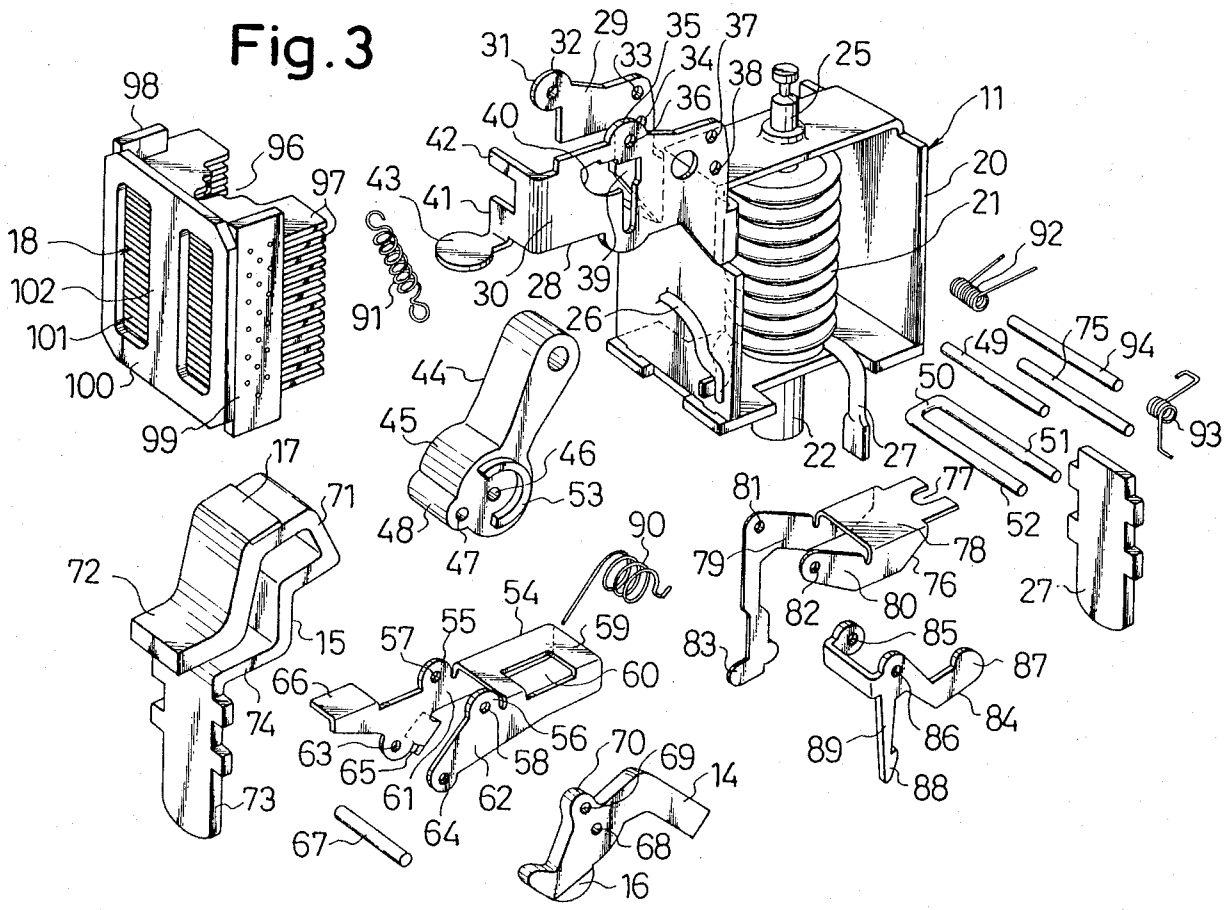
FIG. 3 is a perspective view as disassembled into componential parts of the circuit breaker with the casing removed.
Figure 7:
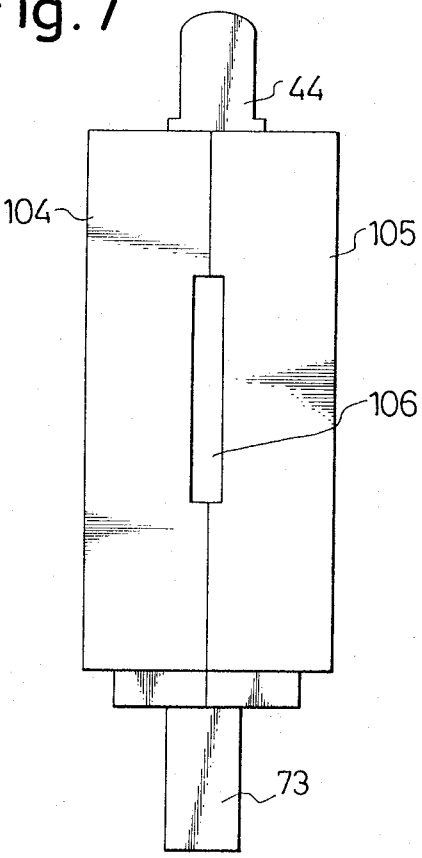
FIG. 7 is an endwise elevation of the foregoing circuit breaker.

On the other hand, a coil spring 90 is mounted about the support shaft 49 of the above described handle 44, and this spring 90 provides always to the handle 44 a rotating force acting in the direction of the contact opening motion, that is, in the clockwise direction in FIG. 2, as being engaged at one end to an angled corner edge of the sliding aperture 39 and at the other end to the leg 51 of the link pin 50 while being guided by a semi-annular guide 53 on the lower part 45 of the handle 44. To the tip end engaging part 42 of the long framing part 30 in the frame 28, further, one end of a return spring 91 is engaged while the other end thereof is engaged in the engaging hole 69 of the movable contactor 14, so that the contactor 14 will be receiving always a force acting in the direction of separating from the fixed contactor 15. Further, an interlocking-arm spring 92 and latch spring 93 are mounted about the support shaft 75 of the interlocking arm 76, and the interlocking-arm spring 92 is engaged at one end to the lower surface of the base part 78 of the interlocking arm 76 and at the other end to an engaging shaft 94 held in the shaft bearing holes 34 and 38 of the frame 28 so as to always urge the interlocking arm 76 in the counterclockwise direction in FIG. 2, that is, in the direction of pulling the second plunger 25 upward. The latch spring 93 is engaged at one end to the engaging shaft 94 and at the other end to such a proper portion of the frame 28 as, for example, circumferential edge of a round hole 95 made in the long framing part 30 so as to be effective to urge the latch member 84 always in the counterclockwise direction, that is, to be engageable to the link arm 54.

Between the arc running extension 43 of the frame 28 and the arc running part 72 of the fixed contactor 15, the arc suppressing means 18 of a unique arrangement in the present invention is disposed. The fixed contact 17 is disposed exteriorly of the arc suppressor and is spaced from a longitudinal axis 111 thereof. This arc suppressing means 18 is provided with the recess 96 through which the tip end of the movable contactor 14 is allowed to pass, and comprises a plurality of deion grids 97 of a U-shape as seen flatly and mutually separated with a small clearance. These deion grids 97 are held between both side plates 98 and 99 and provided at their end edges with an end plate 100 fixed to the side plates 98 and 99. Arc gas discharging opening 101 is made in the end plate 100 while, in the center of the opening 101, a direct-discharge restricting plate part 102 is provided to oppose the recess 96 of the deion grids 97.

A casing 103 for housing therein all of the foregoing constituent members is provided for defining a housing space with mutual engagement of two divided casing halves 104 and 105, which are respectively provided with a notch for forming a rectangular slit 106 in an end wall on the side where the arc suppressing means 18 is disposed when engaged to each other. The slit 106 is positioned behind the direct-discharge restricting plate part 102. The casing 103 further defines in its upper surface part a handle hole 107 which is provided for projecting the handle 44 thereout and restricting its rotation within a predetermined angle of rotation, while allowing the lower part 45 of the handle 44 to be rotatably seated immediately below the hole 107. Inside the caseing 103, a projection suitable for restricting rotating stroke of the link arm 54 as being engaged to the stopping projection 66 of the arm 54 is provided, and a square-shaped pillar 108 to which the U-shaped part 71 of the fixed contactor 15 can be fitted and, preferably, a projected wall 112 for insulating the contactor from environment of the lead wire 26 on the side opposite to the pillar are provided. Further inside the casing 103, bed parts 109 and 110 are provided to project for compactly and stably seating thereon the electromagnetic device 11 and arc suppressing means 18. Such elastic member as a spring may be attached to the above restricting projection so as to cause the link arm 54 to be repelled back, whereby it is made possible to promote rotary motion of the link arm 54 when it rotates in the counterclockwise direction after a rapid rotation in the clockwise direction.

Figure 4:
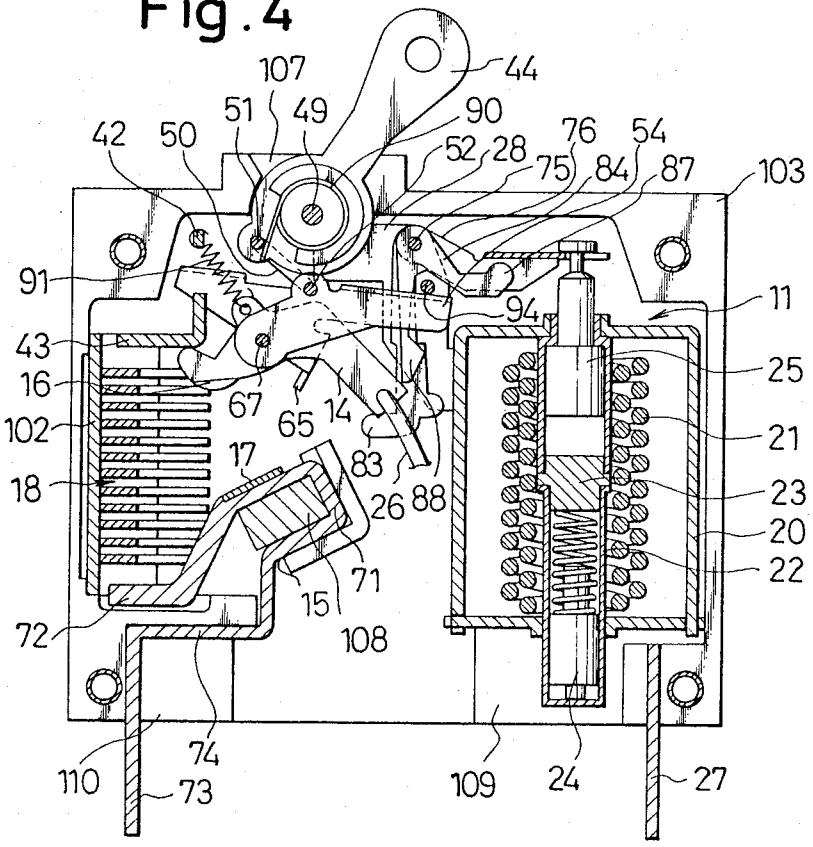
FIG. 4 is a sectioned view as taken along line IV—IV in FIG. 1.
Figure 8:
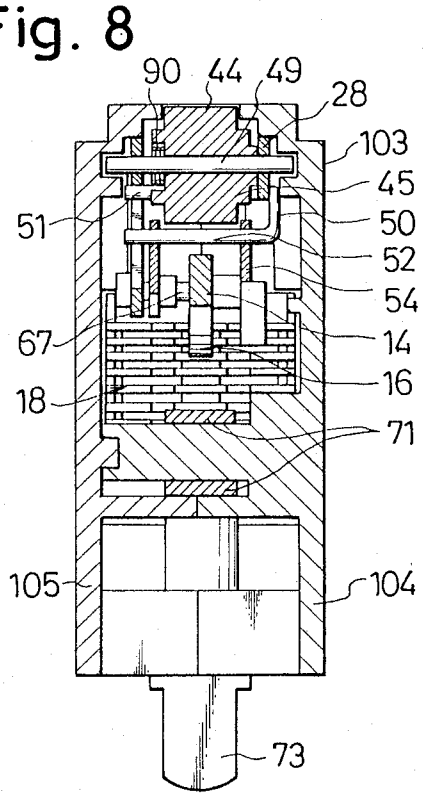
FIG. 8 is a sectioned view taken along line VIII—VIII in FIG. 2.

The operation of the present invention shall be further referred to. Now, when the handle 44 of the manual contact opening and closing mechanism is in the position of FIG. 2 or 4, that is, rotated clockwise in the drawing, the one leg 51 of the link pin 50 is positioned at the uppermost end of the arcuate edge 40 of the guide aperture 39 while the other leg 52 is located at the upper vertical end of the part of the aperture 39 by the biasing force of the return spring 91, the link arm 54 and movable contactor 14 are moved upward. Accordingly, the movable contact 16 of the movable contactor 14 in the opening and closing contact section 13 is separated from the fixed contact 17 of the fixed contactor 15, that is, in its contact opening state. In this case, any upward motion more than required of the link arm 54 is restricted by the projection in the casing. When, on the other hand, the handle 44 is rotated from the position of FIG. 2 or 4 to that of FIG. 5, against the biasing forces of the coil spring 90 mounted on the support shaft 49 for the handle and of the return spring 91, the handle 44 is stopped at its position rotated counterclockwise overcoming the biasing forces of the springs 90 and 91 when the position of the one leg 51 inserted in the through hole 47 of the expanded part 48 at the lower has exceeded an imaginary line connecting the handle support shaft 49 with the other leg 52 of the link pin 50, and the handle is retained there. Thereby the one leg 51 of the link pin 50 is made to reach the lower part of the arcuate edge in the guide aperture 39 and the other leg 52 to reach the lower end of the vertical part in the aperture 39. Thus, the link pin 50 is made to be substantially in a vertical state in which the hook 88 of the latch member 84 engages edgewise the engaging opening 60 of the link arm 54. Thus, the link arm 54 as well as the movable contactor 14 (coupled through the support shaft 67 to the arm 54) are both rotated to be slanted forward to have the movable contact 16 contacted with the fixed contact, and the contact closing state is reached. In this case, an electric circuit is formed by means of the terminal metal fitting 27, coil 21, lead wire 26, movable contactor 14, movable contact 16, fixed contact 17, fixed contactor 15 and terminal metal fitting 73.

Figure 5:
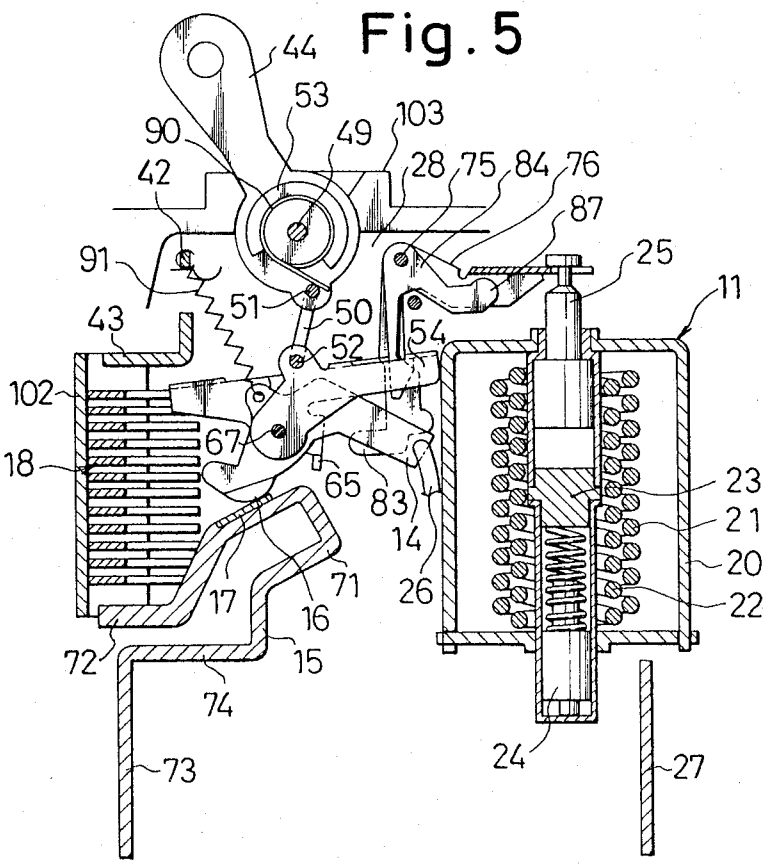
FIG. 5 is a sectioned view showing main parts only of FIG. 4 in contact closing state.
Figure 9:
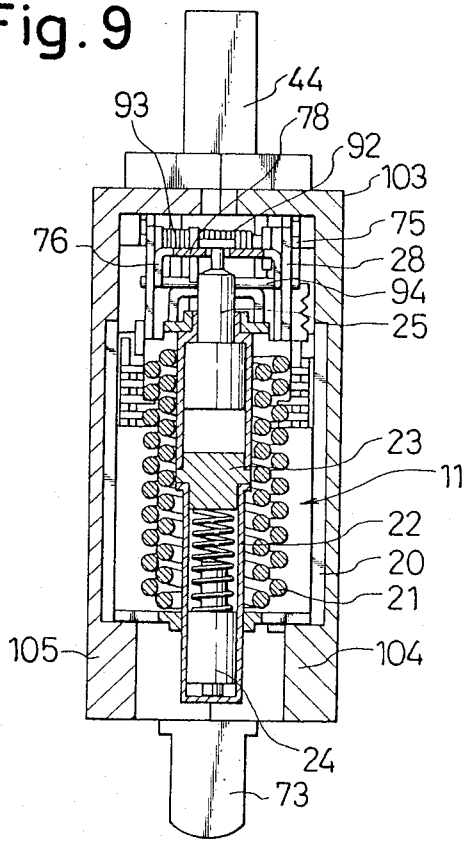
FIG. 9 is a sectioned view taken along line IX—IX in FIG. 2.
Figure 6:
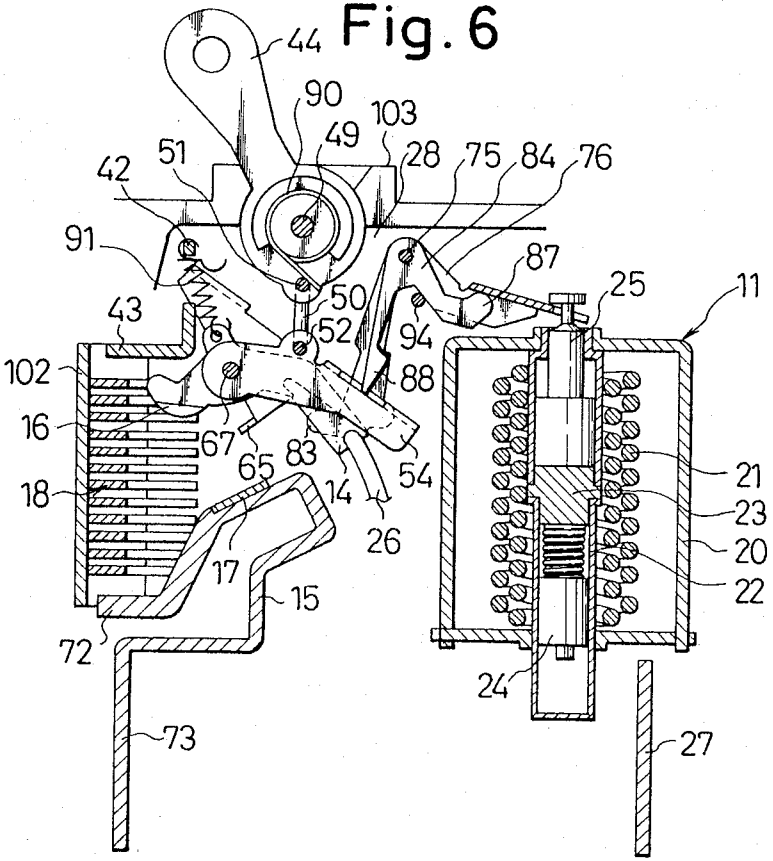
FIG. 6 is a sectioned view similar to FIG. 5 in a state where the electromagnetic device of the foregoing circuit breaker is completely actuated due to the overcurrent.

Further, when such an overcurrent as, for example, a current 1.15 times as large as the rated current keeps flowing in the contact closing state of FIG. 5, the magnetic head 23 is initially excited through the coil 21 in the electromagnetic device 11, and the first plunger 24 is attracted gradually to the magnetic head 23. The permeance of magnetic circuit through the yoke 20 is thereby increased and the second plunger 25 (normally disposed in its upper position through the interlocking arm 76 due to the spring load of the interlocking-arm spring 92) is attracted to the magnetic head 23 against such spring load. Accompanying this, the interlocking arm 76 and latch member 84 are rotated about the support shaft 75 as the center, the hook 88 of the latch member 84 being disengaged from the edge of the engaging aperture 60 of the link arm 54. Also, as shown in FIG. 6, the kicking tongue 65 of the link arm 54 is hit by the kicking foot 83 of the interlocking arm 76 to be moved upward. The link arm 54 is, therefore, subjected to a sort of firm starting force due to such hitting and propelling motion performing a unique action in the present invention whereby rotary force of the link arm 54 is rapidly elevated, and the movable contactor 14 is rapidly separated from the fixed contactor 15 to reach the position of FIG. 6, aided by the return spring 91.

Since, at this time, the electromagnetic driving force produced by the current flowing through the fixed and movable contactors 15 and 14 is caused to act on the arc generated upon the contact opening as has been well known and, in addition, the movable contact 16 itself of the movable contactor 14 positioned outside the arc suppressing means during the contact closing state is caused to pass immediately through the recess 96 of the arc suppressing means 18, the arc is divided, cooled and extremely effectively suppressed within this arc suppressing means. In this case, as the fixed contactor 15 is slanted at the portion adjacent the fixed contact 17 to be positioned very close to the arc suppressing means 18 as has been described, the generaged arc is made to effectively shift to the arc suppressing means 18 even before it reaches the arc running part 72 so that the arc suppressing efficiency will be also elevated by this arrangement. When the movable contactor 14 has moved upward, further, the upper part of its tip end is positioned very close to the frame 28 so that there can be formed an electric path through the frame 28 having the arc running extension 43 and the yoke 20 integral with the frame 28 after the contact opening.

In addition, while an arc gas generated upon the arc suppression can be discharged from the discharging opening 101 formed in the end plate 100 of the arc suppressing means 18 through the slit 106 of the casing 103 to the exterior, the provision of the direct discharge restricting plate 102 in the discharge opening 101 as aligned in the longitudinal direction of the casing 103 with the slit 106 causes the arc gas to go around the restricting plate 102 without being directly discharged to the exterior, whereby the gas discharge can be made relatively gradual and any rapid arc gas discharge can be prevented. The rapid arc gas discharge is not desirable since the divided arcs inside the arc suppressing means 18 are caused to be mutually short-circuited through the arc gas in the exterior of the suppressing means again and the arc suppressing efficiency is deteriorated. The slight separation at one arm 87 of the latch member 84 from the lower surface at the base portion of the interlocking arm 76 renders the second plunger 25 of the electromagnetic device 11 not to be subjected to any load incurred by the weight of the latch member 84 as well as its associated members but rather to be actuatable at a predetermined current level upon, for example, the short-circuit.

Further, when the short-circuit current, that is, a current which is two or three times as large as the rated current flows, only the second plunger 25 is immediately attracted to the magnetic head 23 since the exciting force of the coil 21 is extremely large, and the interlocking arm 76 and latch member 84 are caused to be instantaneously actuated. Except for this respect, the same operation as that performed when the overcurrent flows as has been disclosed is also performed upon the short-circuit, and the same function can be obtained.

POSSIBILITY OF INDUSTRIAL UTILIZATION

In the circuit breaker according to the present invention arranged as has been disclosed, specifically the movable-contact carrying part of the movable contactor is always caused to pass through the interior of the arc suppressing means upon the opening operation of the closing and opening contact section, and the arc dividing, cooling and suppressing are remarkably improved. At the time of the trip operation, further, the link arm 54 supporting the movable contactor is hit and propelled, whereby the contact opening operation with respect to the fixed contactor can be performed extremely quickly. Generally, the current limiting effect of the breaker can be improved to a large extent and the large current flow to the circuit can be effectively prevented, so that such element weak to the overcurrent as semiconductors even included in the circuit can be sufficiently protected and remarkable effects can be realized when utilized in the technical field as referred to.

We claim:

1. A circuit breaker comprising:

a casing, a manually actuable contact opening and closing mechanism including a handle rotatably mounted within said casing and projecting out of said casing, a link member operably connected to said handle to be shifted between first and second positions in response to rotation of said handle, said link member being pivotable relative to said handle about a first pivot axis, and trip means comprising a lever shiftable between:

a normal position in which said lever engages said link member when the latter is in said second position, and an abnormal position in which said lever is disengaged from said link member, a movable contactor pivotably carried by said link member and including a movable contact, a fixed contactor having a fixed contact arranged to be:

disengaged from said movable contact when said link member is in said first position, and engaged by said movable contact when said link member is in said second position and is engaged by said lever, an electromagnetic device including a coil which detects an overcurrent and means operably connected to said lever for responding to the sensing of an overcurrent to shift the lever to said abnormal position to release said lever from said link member when the latter is in said second position, means for rotating said link member about said first pivot axis when said link member is in said second position and is released from said lever, whereby said movable contact is displaced in a path of travel to become disengaged from said fixed contact, arc suppressing means disposed adjacent said fixed contact and including an interior recess coinciding with said path of travel of said movable contact such that said movable contact enters and moves along the interior of said arc suppressing means when moving in said path of travel, said fixed contactor including a terminal end connectible to a source of current and a tip end located remotely of said terminal end and adjacent a first longitudinal end of said arc suppressing means, said fixed contactor further including first and second sections located intermediate said terminal end and said tip end, said first section carrying said fixed contact and locating same exteriorly of said arc suppressing means and spaced from a longitudinal axis of the latter at a level situated between the longitudinal ends of said arc suppressing means, said second section extending from said first section toward said tip end so as to extend toward said first longitudinal end of said arc suppressing means in a direction which is oriented diagonally relative to said longitudinal axis of said arc suppressing means.

2. A circuit breaker according to claim 1, wherein said trip means includes an arm which includes a kicking foot which is displaced against a portion of said link member, when said lever is moved to said abnormal position, to promote pivotal movement of said link member about said first pivot axis.

3. A circuit breaker according to claim 1, wherein a portion of said diagonally disposed second section of said fixed contactor is situated within said interior recess of said arc suppressing means.

4. A circuit breaker comprising a casing; a manual contact opening and closing mechanism enclosed in said casing, said mechanism including a handle projected partly out of the casing and held rotatably thereto for actuating manually the mechanism, a link member coupled rockably to said handle to be shiftable up and down with rotations of the handle, and a trip means including a lever shiftable between a normal position in which said link member is engageable at one end with said lever when the member is shifted down and an abnormal position in which the link member is disengaged from the lever; a movable contactor having at one end a movable contact and rockably supported by said link member to be shiftable therewith; a fixed contactor having a fixed contact with which said movable contact of said movable contactor is contactable to close the contacts when the movable contactor shifts and rocks with said link member engaging with the lever of said trip means; an arc suppressing means disposed adjacent said fixed contact and extending in a direction in which said one end having the movable contact of the movable contactor moves, said fixed contactor being provided to position said fixed contact outside said arc suppressing means, and said one end having the movable contact of the movable contactor passing through the interior of the arc suppressing means during its movement; and an electromagnetic device including a coil to be responsive to an overcurrent for shifting said lever of said trip means from said normal position to said abnormal position to cause the link member to be disengaged from the lever and rocked to shift up at the other end together with the movable contactor for forcibly opening the contacts; wherein said fixed contactor being formed to have a U-shaped part, one leg portion of which U-shaped part carrying said fixed contact and extended diagonally relative to a longitudinal axis of said arc suppressor to a longitudinal end part of said arc suppressing means to form an arc running part while the other leg is fixed to the casing, and said U-shaped part being fited to a rectangular projection provided inside the casing.

5. A circuit breaker according to claim 4, wherein said casing includes a projecting wall disposed on a side of said fixed contactor located opposite said rectangular projection, to electrically insulate said U-shaped part of said fixed contactor which is fitted to said rectangular projection.

* * * * *